United States Patent [19]

Carnaghi et al.

[11] 4,327,447

[45] May 4, 1982

[54] LINED POCKET WITH STITCH-FREE UPPER OUTER PART

[75] Inventors: Arturo A. Carnaghi, St. Louis; Howard M. Zins, Manchester, both of Mo.

[73] Assignee: Angelica Corporation, St. Louis, Mo.

[21] Appl. No.: 186,737

[22] Filed: Sep. 12, 1980

[51] Int. Cl.[3] ..... A41D 27/20

[52] U.S. Cl. ..... 2/247

[58] Field of Search ..... 2/247, 248, 253, 249, 2/250, 251, 252, 254

[56] References Cited

U.S. PATENT DOCUMENTS 1,542,678 6/1925 Dreiginas ..... 2/247

2,295,425 9/1942 Potter ..... 2/247

OTHER PUBLICATIONS

American Thread "Pucker" 3-1971, TiB#002.

*Primary Examiner*—Doris L. Troutman

*Attorney, Agent, or Firm*—Rogers, Eilers & Howell

[57] ABSTRACT

A pocket, for a garment, has a piece of material that serves as the outer part of that pocket and that has the upper portion thereof folded inwardly and downwardly to form a fold that serves as the upper portion of the inner surface of that part, and has a second piece of material that serves as the lining of that outer part and that has the upper end thereof connected to the fold which serves as the upper portion of the inner surface of that outer part and that has portions of the sides and bottom thereof connected to the sides and bottom of that outer part, and the connected sides and bottoms of that outer part and of that lining are connected to the garment as a patch pocket. The upper central area of the outer part of that pocket is wholly devoid of stitches, and hence is devoid of puckers.

12 Claims, 7 Drawing Figures

LINED POCKET WITH STITCH-FREE UPPER OUTER PART

BACKGROUND OF THE INVENTION

A lined pocket for a garment frequently has a row of stitching across the upper outer part of that pocket. All too often, that row of stitching creates, or facilitates the creation of, "puckers", and those puckers can provide an unsightly appearance for that pocket.

Appearance, as well as utility, is important in the making and marketing of wearing apparel; and puckers inherently detract from the appearance of wearing apparel. The March 1971 Technical Information Bulletin of American Thread is entitled PUCKER; and it includes many statements regarding "pucker" and "puckering". That bulletin refers to the puckering problem, and then tries to teach manufacturers of wearing apparel "How To Combat Pucker". A few of the many statements regarding "pucker" and "puckering" in that bulletin are:

"One major problem to the apparel manufacturer and to those who serve him is puckering", "Puckering can happen in almost all apparel sewing operations", "Many efforts have been made by apparel, sewing machine and needle manufacturers, fiber producers, fabric manufacturers, thread manufacturers and others to suggest ways to minimize the puckering problem", "American Thread is called upon continually to supply threads that will eliminate or reduce puckering. These requests are made even though it is generally recognized that 80 to 90% of the puckering which occurs is traceable to conditions other than thread. Our extensive research to determine puckering causes, and to suggest ways to eliminate it, has resulted in many helpful hints for the manufacturer".

"Factors that can result in puckering are: Fabric, Thread, Seam Type, Stitch Type, Stitch Rating, Sewing Direction, Operator Techniques, Sewing Operation Adjustments, Needle".

"One type of inherent pucker is brought about by the displacement of the densely woven yarns during sewing by the needle and thread".

"Pucker may not be visible after sewing in some instances but may appear after washing".

"Puckering can often be eliminated before it becomes a problem by first selecting the correct thread for the sewing application".

"Some apparel seams and stitches are more likely to cause puckering than others. When puckering occurs due to seam or stitch types, suitable alternatives should be considered".

"Generally speaking, fewer stitches per inch are preferred to minimize pucker".

"Conversely, if the stitch direction is sewn parallel to the warp, a highly puckered seam can result".

"Shirt manufacturers have found that the appearance of the sewn pocket is very satisfactory if the pockets are cut so the warp runs diagonally to the stitch direction".

"Operator technique is also a major factor in puckering".

"Another common operator cause of pucker is setting a pocket on a shirt. Here an operator often pulls on the shirt front to relocate it after it is partially sewn—producing a similar pucker condition as in the previous example. The best solutions to poor operator technique that result in puckering are obtained using auxiliary aids that reduce operator variability. Automatic collar running devices, pocket setters, and buttonholers are very useful in this respect".

"Frequently, improper adjustments to the sewing machine can be the source of poor seam appearance due to puckering".

"The type and size of needle can be the beginning or the end of your pucker problem".

"SUMMARY—HOW TO COMBAT PUCKER

1. Sew with less tension on both the upper and bottom thread than normal. On stitch type 401, overfeed needle thread to consume 60% with 40% looper thread.
2. Make sure that the tension checkspring is in proper adjustment so that the thread casts off the bobbin case readily.
3. Use the finest size feed dogs possible. Use a size feed dog which best combines with the presser foot and throat plate for the operation involved.
4. Use the least amount of presser foot tension that will permit the movement of the goods during the sewing operation.
5. Use the smallest size needle possible considering undue needle breakage.
6. Use the smallest throat plate opening possible to prevent the fabric from being pushed down into the throat plate hole during the sewing operation.
7. Use the finest size thread consistent with good sewability.
8. Reduce the number of stitches per inch consistent with good appearance on seams such as closing side seams and attaching shirt pockets.
9. It may be possible to reduce the pucker by slowing down the sewing machine speed. The reduction of speed may permit better operator handling of the pieces during the stitching operation as well as tend to minimize distortion during the acceleration period.
10. In the felling operation, using an LSc-2 seam, be sure that the folders are opened wide enough so that the material does not drag or bind. Consider replacement of defective attachments.
11. Call your American Thread Salesman for assistance. He can also provide the able service of our Sewing Engineers and other Technology Specialists."

Some manufacturers of wearing apparel have attempted to minimize puckers on the outer parts of pockets by using folded pieces of material as those outer parts, and by stitching just the sides and bottoms of those outer parts. However, some materials, such as knit fabrics and textured woven fabrics, are not particularly useful as linings for pockets. Specifically, such fabrics can stretch unduly, they tend to wear at unduly high rates, they tend to catch or snag the fingernails of wearers of the apparel, and they can make the pockets unduly bulky.

SUMMARY OF THE INVENTION

A pocket, for a garment, has a piece of material that serves as the outer part of that pocket and that has the upper portion thereof folded inwardly and downwardly to form a fold which serves as the upper portion of the inner surface of that part, and has a second piece of material that serves as the lining of that outer part and that has the upper end thereof connected to the fold which serves as the upper portion of the inner surface of that outer part and that has portions of the sides and bottom thereof connected to the sides and bottom of that outer part, and the connected sides and bottom of that part and of that lining are connected to the garment as a patch pocket. The upper central area of the outer part of that pocket is wholly devoid of stitches, and hence is devoid of puckers. It is, therefore, an object of the present invention to provide a piece of material that serves as the outer part of a pocket, that has the upper portion thereof folded inwardly and downwardly to form a fold which serves as the upper portion of the inner surface of that part, and that has the free edge of that fold secured to the upper edge of a second piece of material which serves as the lining for that outer part; and the sides and bottom of that outer part are secured to the sides and bottom of that lining and also to a garment to form that pocket.

The free edge of the fold of the outer part is secured to the upper edge of the piece of material which serves as a lining; and it may be so secured by a row of stitches, a row of heat-bonded points of securement, a row of spots of adhesive, or some other row of points of securement. The resulting plural-layer connection, with its row of points of securement, is substantially stiffer than all adjacent portions of that fold and also is substantially stiffer than all adjacent portions of that lining. This is desirable; because the greater stiffness of that plural-layer connection helps to keep the upper area of the outer part of the pocket, and the adjacent portion of the garment, free of wrinkles and puckers. It is, therefore, an object of the present invention to provide a plural-layer connection between the free edge of a fold on an outer part of a pocket and the upper portion of the lining for that outer part, and to provide a row of securement means which helps make that plural-layer connection stiffer than the adjacent portions of that fold or of that lining.

The plural-layer connection, between the free edge of the fold on the outer part of the pocket and the upper portion of the piece of material which serves as the lining of that outer part, automatically spaces the folded edge between that fold and that outer part a finite distance outwardly from the confronting portion of the garment. That finite spacing is important in minimizing the snagging, tearing or cutting of the folded edge, between the upper areas of that outer part and of that fold, as the wearer of the garment inserts his or her fingers, or various sharp-edged objects, into the pocket. Also, that finite spacing reduces the tendency of the wearer's fingers, or of objects being inserted into the pocket, to force the folded edge—between the upper areas of the outer part and of the fold—downwardly during the insertion of those fingers or of those objects into the pocket. It is, therefore, an object of the present invention to provide a plural-layer connection, between a fold on the outer part of a pocket and the upper portion of a lining for that outer part, which spaces that fold a finite distance outwardly from the confronting portion of the garment of which that pocket is a part.

Other and further objects and advantages of the present invention should become apparent from an examination of the drawing and accompanying description.

In the drawing and accompanying description a preferred embodiment of the present invention is shown and described, but it is to be understood that the drawing and accompanying description are for the purpose of illustration only and do not limit the invention and that the invention will be defined by the appended claims.

DETAILED DESCRIPTION OF PREFERRED EMBODIMENT

Figures 1, 2, 3, 4, 5, 6, 7:
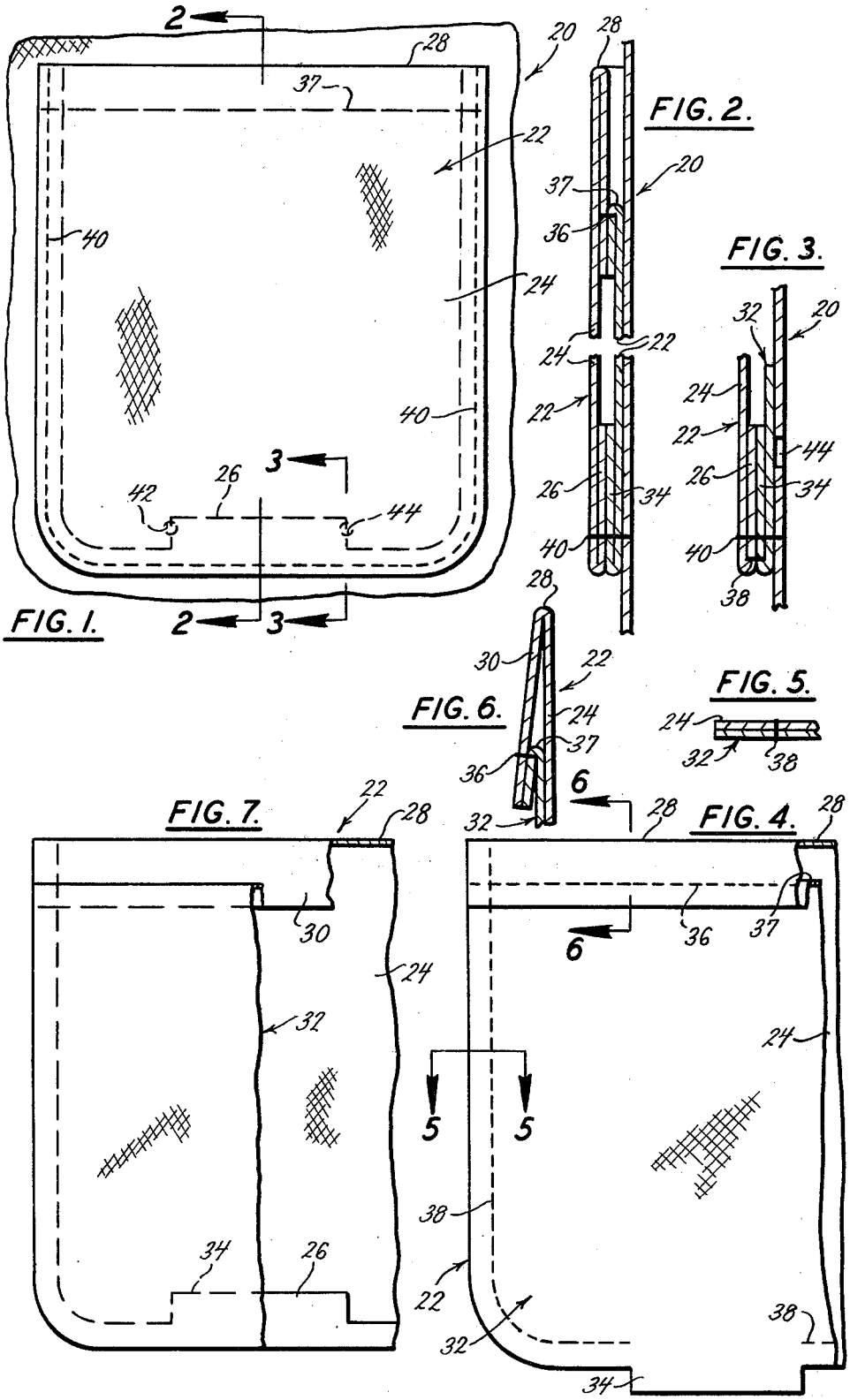
FIG. 1 is a front elevational view of one preferred embodiment of pocket, that is made in accordance with the principles and teachings of the present invention, and of a portion of a garment of which that pocket is a part.
FIG. 2 is a broken sectional view, on a larger scale, and it is taken along the plane indicated by the line 2—2 in FIG. 1.
FIG. 3 is a sectional view, on the scale of FIG. 2, and it is taken along the plane indicated by the line 3—3 in FIG. 1.
FIG. 4 is a broken-away rear elevational view, on the scale of FIG. 1, of the pocket of FIG. 1 after the outer part thereof has had the lining therefor secured thereto.
FIG. 5 is a sectional view, on the scale of FIG. 2, and it is taken along the plane indicated by the line 5—5 in FIG. 4.
FIG. 6 is a sectional view, on the scale of FIG. 2, and it is taken alone the plane indicated by the line 6—6 in FIG. 4.
FIG. 7 is a broken-away rear elevational view, on the scale of FIG. 1, of the front part and lining of the pocket after they have been turned "right side out".

Referring to the drawing in detail, the numeral 20 generally denotes a garment which has one preferred embodiment of pocket of the present invention secured thereto as a part thereof. That garment can be a coat, jacket or other article of wearing apparel which has at least one patch packet thereon; and it can be made from any of the wide range of kinds and varieties of materials that can be used in making coats, jackets or other articles of wearing apparel which have patch pockets thereon. The numeral 22 generally denotes a patch pocket on the garment 20; and the outer part of that pocket is denoted by the numeral 24. That outer part can be made from any of the wide range of kinds and varieties of materials that can be used in making the outer parts of pockets. A generally-rectangular tab 26 is provided at the bottom of that outer part; and that tab is shown in FIGS. 1, 2, 3 and 7. The upper portion of the outer part 24 is bent inwardly and downwardly to form a fold 30 and a folded edge 28. As indicated by FIG. 2, that fold confronts, and is in intimate engagement with, the inner surface of the upper area of the outer part 24. The folded edge 28 constitutes the top of the pocket 22.

The numeral 32 generally denotes the lining for the pocket 22; and that lining has a generally-rectangular tab 34 at the bottom thereof. That tab preferably has the same size and configuration as the tab 26 at the bottom of the outer part 24. Further, the tab 34 and the tab 26 are in register with each other. The lining 32 can be made from any of the wide range of kinds and varieties of materials that can be used in making linings for patch pockets.

The numeral 36 denotes a line of stitches which fixedly secures the free edge of the downwardly and inwardly bent fold 30 to the upper portion of the lining 32. That line of stitches preferably will be formed before the upper portion of the outer part 24 is bent inwardly and downwardly to form the fold 30 and the folded edge 28, and while the lining 32 is lying in faceto-face relation with that outer part. Subsequently, the upper portion of the lining 32 will be bent immediately adjacent the line 36 of stitches to form the folded edge 37, and the upper portion of the outer part 24 will be bent to define the fold 30 and the folded edge 28—all as shown by FIGS. 4–6. At this time, the pocket has its "wrong side out."

The outer part 24 is made wide enough to provide ample seams at each side of the pocket; and it is made tall enough to provide an ample seam at the bottom and to provide sufficient material at the top thereof to form the fold 30. The vertical dimension of that fold preferably is in the range of one-half of an inch to one inch. The lining 32 is made so the width thereof is the same as the width of the outer part 24 but so the height of that lining is less than the height of that outer part. The height of the lining 32 is great enough to provide an ample seam at the bottom of that lining but to dispose the fold 37, adjacent the upper edge of that lining, well below the folded edge 28, as indicated particularly by FIGS. 2, 4, 6 and 7.

After the line 36 of stitches has fixedly secured the free edge of the downwardly and inwardly bent fold 30 to the upper portion of the lining 32, after the upper portion of that lining has been bent to define the folded edge 37, and after the upper part 24 has been bent to define the folded edge 28 and the fold 30, rows 38 of stitches are provided to fixedly secure the sides of the outer part 24 to the sides of the lining 32. The lower ends of those rows of stitches extend inwardly to points that are located above the level of, and are in vertical registry with, the sides of the tabs 26 and 34—as indicated by FIG. 4. Not only do those rows of stitches fixedly secure the sides of the outer part 24 to the sides of the lining 32, but they also secure portions of the bottom of that outer part to corresponding portions of the bottom of that lining. Importantly, the rows 38 of stitches do not extend across the central upper area of the outer part 24; and hence that central upper area is wholly devoid of stitches. The rows 38 of stitching leave the tabs 26 and 34 free to move relative to each other, and additionally leave the areas of the outer part 24 and of the lining 32, which are adjacent those tabs, free to move relative to each other.

Once the rows 38 of stitches have been formed, the pocket 22 is in condition to be converted from the "wrong-side-out" condition of FIG. 4 to the "right-side-out" condition of FIG. 7. To convert that pocket from the condition of FIG. 4 to the condition of FIG. 7, the upper portions of the outer part 24 and the upper portions of the lining 32 are moved downwardly to and through the unstitched area which is above, and in register with, the tabs 26 and 34. After those upper portions have been moved through that unstitched area, the rest of the outer part 24 and the rest of the lining 32 will be moved through that unstitched area until the side and bottom seams and the tabs 26 and 34, respectively, of the outer part 24 and of the lining 32 are wholly within the pocket 22—as indicated by the dashed line adjacent the left-hand side and bottom of FIG. 7. At this time, the row 38 of stitches will not be visible if the pocket 22 is viewed in front elevation. Similarly, neither the row 36 of stitches, the folded edge 37, nor the fold 30 will be visible if that pocket is viewed in front elevation. Also at this time, the outer part 24 and the lining 32 will constitute an envelope; and all cut edges of that outer part and of that lining will be wholly confined within that envelope. As a result, none of those cut edges is visible.

To secure the pocket 22 to the garment 20, and also to fixedly connect the previously-unstitched areas of the outer part 24 and of the lining 32 that are in register with the tabs 26 and 34, a row 40 of stitches is provided. That row of stitches extends through the outer part 24, through the lining 32 and through the garment 20. That row of stitches extends downwardly along one side of that pocket, extends across the bottom of that pocket, and extends upwardly along the other side of that pocket. As indicated particularly by FIG. 1, that row of stitching is close to the outer edge of the pocket 22. In some instances, where fashion or customers' desires dictate, the row 40 of stitches can be spaced an appreciable distance inwardly from the sides and bottom edges of that pocket. The areas of the outer part 24 and of the lining 32 that are in register with the tabs 26 and 34 will be fixedly connected, even when the row 40 of stitches is spaced an appreciable distance inwardly from the bottom edge; because the upper edges of those tabs will be fixedly connected by that row of stitches.

As shown by FIGS. 2 and 3, and as indicated by FIGS. 1 and 7, all of the cut edges of outer part 24 and of lining 32 are wholly between that outer part and that lining. As a result, none of those cut edges could be contacted by the fingers of the wearer of the garment 20 or by any object inserted in pocket 22. This avoids raveling or fraying of those cut edges, and also frees the wearer's hands from contact with those edges.

The row 40 of stitches will be made as unobtrusive as the requirements of strength and durability permit; and the stitches of that row will complete the making and application of the pocket 22. The various folded edges of the pocket 22 preferably will be pressed as they are formed. Where the outer part 24 is made from material that has been treated with "permanent press" coating or impregnant, the fabricated garment 20 will be heat treated to help those folded edges retain their smooth and neat folded appearance and to help the outer part 24 retain its smooth and neat flat appearance.

As indicated particularly in FIG. 2, the lower end of fold 30, the portion of lining 32 which depends downwardly from the row 36 of stitches, the portion of that lining which depends downwardly from the folded edge 37, and that row of stitches form a plural layer connection between that fold and that lining. That plural-layer connection is stiffer and more resistant to wrinkling than is any other portion of the outer part 24, and also is stiffer and more resistant to wrinkling than is any adjacent portion of the garment 20. As a result, that plural-layer connection materially helps keep wrinkles or puckers from forming in the folded edge 28, in the upper area of the outer part 24, or in the adjacent area of the garment 20. Consequently, that plural-layer connection helps provide a neat and tailored appearance for that garment—not only initially, but also after repeated launderings.

As indicated by FIG. 2 the plural-layer connection between the lower end of fold 30 and the upper portion of lining 32 spaces the folded edge 28 outwardly a finite distance from the confronting portion of the garment 20. That finite spacing is desirable, because it reduces the tendency of a wearer's fingernails to snag that folded edge or to downwardly distort portions of the length of that folded edge as that wearer inserts his or her hands in the pocket 22. Also that finite spacing is desirable, because it reduces the tendency of objects, which are being inserted into that pocket, to snag that folded edge or to downwardly distort portions of the length of that folded edge. All of this means that the plural-layer connection will tend to maintain a neat and tailored appearance for the garment 20, even when the pocket is subjected to excessive use and to possible abuse.

By leaving the entire upper central area of the outer part 24 wholly devoid of stitches, and by providing the plural-layer connection between the lower end of fold 30 and the upper portion of lining 32, the present invention minimizes wrinkling and puckering of that upper central area and of the folded edge 28. In fact, the present invention makes it possible to provide pockets that are substantially free of wrinkles and puckers, even where the warp of the material is exactly parallel to the folded edge 28.

As indicated by FIGS. 1 and 2, the folded edge 37 and all other parts of the lining 32 are concealed by the outer part 24 when the pocket 22 is secured to the garment 20. As a result, the structure which minimizes or eliminates wrinkling or puckering of the folded edge 28 and of the upper central area of the outer part 24 is wholly invisible to persons viewing the wearer of the garment 20, and yet automatically and effectively performs its wrinkle-minimizing and pucker-minimizing function.

The garment 20 can be made from woven or nonwoven (felted, knitted, spun bonded, spun laced or the like) materials. Moreover, that garment can be made from wool, cotton, polyester or blended materials; and those materials can have any desired numbers of warp and woof treads or their equivalent, and those threads can have any desired denier count or its equivalent. The lining 32 preferably is made from a material which is lighter in weight and is thinner than the material of which the outer part is made. Also, that lining preferably is made from a material which is tightly fabricated, has a high abrasion resistance, a high snag resistance, a high wrinkle resistance, a high slippage resistance, a high degree of color fastness or a high degree of whiteness, a high degree of smoothness, a high crease retention, and a low shrinkage factor. One preferred lining material is a continuous filament polyester taffeta fabric that uses one hundred and fifty (150) denier thread, has seventy-eight (78) warp threads per inch, has sixty-two (62) woof threads per inch, has a total of one hundred and forty (140) threads per inch, has a thickness of five (5) mils, and has a weight of only two and nine-tenths (2.9) ounces per square yard. Such a lining material is lighter, thinner and less expensive than—and yet is more tightly fabricated, has a higher abrasion resistance, a higher snag resistance, a higher wrinkle resistance, a higher slippage resistance, a higher degree of smoothness, and a higher crease retention than—a desirable material, for the outer part 24, such as a textured woven polyester fabric which has sixty-two (62) warp threads per inch, has sixty (60) woof threads per inch, has a total of one hundred and twenty-two (122) threads per inch, has a thickness of twenty-one (21) mils, and has a weight of six and two-tenths (6.2) ounces per square yard. Although many different woven and nonwoven materials could be used for the lining 32, each such material should be made from threads having a denier number of at least one hundred fifty (150 or an equivalent size on another scale, and should have more than one hundred and twenty-six (126) threads per inch, or an equally tight structure.

The making of the pocket 22 from two separate pieces of material is desirable because it enables the outer part 24 to be made from a material that is well suited for use as such an outer part, while enabling the lining 32 to be made from a material that is well suited for use as such a lining. In addition, the making of that pocket from two separate pieces of material enables a manufacturer to replace either the outer part 24 or the lining 32 in the event a defect, blemish or tear was noted on final inspection.

The outer part 24 preferably is secured to the lining 32 by stitches, and that connected outer part and lining preferably are connected to the garment 20 by stitches. However, where possible and where desired, thermally-bonded points of attachment, adhesive points of attachment, or other points of attachment could be used instead of stitches.

The numerals 42 and 44 denote holes which are provided in the garment 20 at points which are close to the bottom of the pocket 22—as indicated particularly by FIGS. 1 and 3. Those holes are quite small—preferably in the range of one-sixteenth (1/16) to one-eighth (⅛) of an inch in diameter. Those holes will promptly drain away substantially all water or cleaning fluid that may become trapped in the pocket during the washing or dry cleaning of the garment 20. That prompt draining is important in preventing the development of unsightly sag lines, bulge lines or puckers due to the retention of entrapped water or cleaning fluid in those pockets as the rest of the garment 20 dries. Any small amounts of water or cleaning fluid which could be retained in the pocket 22 below the level of the openings 42 and 44 would be so minimal that they could not create visible sag lines, bulge lines or puckers. The holes 42 and 44 are so small that no objects of the type normally carried in pockets could possibly become lost by passing through those openings.

The present invention is particularly useful for, and in the making of, pockets. However, that invention also is useful for, and in the making of, plackets, collars, and other components of garments.

The drawing and accompanying description have shown and described a preferred embodiment of the present invention but it should be understood that various changes may be made in the form of the invention without affecting the scope thereof.

What I claim is:

1. A garment which has a portion thereof that serves as the inner face of a component of said garment, a first piece of material which serves as the outer face of said component of said garment, and a second piece of material which serves as the lining of said outer face of said component of said garment, said first piece of material having the upper portion thereof folded inwardly and downwardly to be adjacent the upper area of the inner surface of said outer face of said component of said garment and to confront part of the upper area of said portion of said garment, points of securement that connect the free edge of said inwardly and downwardly folded upper portion of said first piece of material to the upper portion of said second piece of material, further points of securement that connect portions of the sides and of the bottom of said first piece of material to confronting portions of the sides and of the bottom of said second piece of material, and additional points of securement that connect said interconnected first and second pieces of material to said portion of said garment, the visible upper portion of said first piece of material being wholly devoid of points of securement, and hence being free of puckering.

2. A garment as claimed in claim 1 wherein said component of said garment is a patch pocket and wherein a folded edge between said visible upper portion of said first piece of material and said inwardly and downwardly folded upper portion of said first piece of material constitutes the upper edge of said pocket.

3. A garment as claimed in claim 1 wherein all cut edges of said first piece of material and of said second piece of material are disposed between said first piece of material and said second piece of material.

4. A garment as claimed in claim 1 wherein said component of said garment is a patch pocket and wherein a folded edge between said visible upper portion of said first piece of material and said inwardly and downwardly folded upper portion of said first piece of material constitutes the upper edge of said pocket, wherein said free edge of said inwardly and downwardly folded upper portion of said first piece of material and said upper portion of said second piece of material define a plural-layer connection between said inwardly and downwardly folded upper portion of said first piece of material and said upper portion of said second piece of material, and wherein said plural-layer connection helps keep said visible upper portion of said first piece of material free of puckering.

5. A garment as claimed in claim 1 wherein said component of said garment is a patch pocket, wherein all cut edges of said first piece of material and of said second piece of material are disposed between said first piece of material and said second piece of material, and wherein the interior of said pocket is wholly devoid of cut edges of material.

6. A garment as claimed in claim 1 wherein said component of said garment is a patch pocket and wherein a folded edge between said visible upper portion of said first piece of material and said inwardly and downwardly folded upper portion of said first piece of material constitutes the upper edge of said pocket, wherein said free edge of said inwardly and downwardly folded upper portion of said first piece of material and said upper portion of said second piece of material define a plural layer connection between said inwardly and downwardly folded upper portion of said first piece of material and said upper portion of said second piece of material, and wherein said plural-layer connection spaces said upper edge of said pocket a finite distance away from the confronting portion of said garment.

7. A garment as claimed in claim 1 wherein said component of said garment is a patch pocket, wherein the bottom of said pocket is closed, wherein a small hole is provided in a portion of said garment which is in register with the lower portion of said inner surface of said outer face of said component of said garment but is spaced above the level of said closed bottom of said pocket, and wherein said small hole will prevent the passage of solid objects through it but will permit water or cleaning fluid to pass through it.

8. A pocket-forming member that is securable to a garment to help form a patch pocket for said garment and that comprises a first piece of material which serves as the outer face of said pocket-forming member, a second piece of material which serves as the lining of said outer face of said pocket-forming member, said first piece of material having the upper portion thereof folded inwardly and downwardly to be adjacent the upper area of the inner surface of said outer face of said pocket-forming member, points of securement that connect the free edge of said inwardly and downwardly folded upper portion of said first piece of material to the upper portion of said second piece of material, and further points of securement that connect portions of the sides and of the bottom of said first piece of material to confronting portions of the sides and of the bottom of said second piece of material, the visible upper portion of said first piece of material being wholly devoid of points of securement, and hence being free of puckering.

9. A pocket-forming member as claimed in claim 8 wherein said first piece of material and said second piece of material constitute an envelope, and wherein all cut edges of said first piece of material and of said second piece of material are wholly disposed within said envelope.

10. A pocket-forming member as claimed in claim 8 wherein a folded edge between said visible upper portion of said first piece of material and said inwardly and downwardly folded upper portion of said first piece of material constitute the upper edge of said pocket, and wherein said second piece of material is secured to said inwardly and downwardly folded upper portion of said first piece of material along a line which is spaced below the level of said folded edge between said visible upper portion of said first piece of material and said inwardly and downwardly folded upper portion of said first piece of material.

11. A pocket-forming member as claimed in claim 8 wherein said free edge of said inwardly and downwardly folded upper portion of said first piece of material and said upper portion of said second piece of material define a plural-layer connection between said inwardly and downwardly folded upper portion of said first piece of material and said upper portion of said second piece of material, and wherein said plural-layer connection helps keep said visible upper portion of said first piece of material free of puckering.

12. A pocket-forming member as claimed in claim 8 wherein a folded edge between said visible upper portion of said first piece of material and said inwardly and downwardly folded upper portion of said first piece of material constitutes the upper edge of said pocket, wherein said free edge of said inwardly and downwardly folded upper portion of said first piece of material and said upper portion of said second piece of material define a plural layer connection between said inwardly and downwardly folded upper portion of said first piece of material and said upper portion of said second piece of material, and wherein said plural-layer connection will space said upper edge of said pocket a finite distance away from the confronting portion of any garment to which said pocket-forming member is secured.

* * * * *